US011433388B2

(12) United States Patent
Döbele

(10) Patent No.: US 11,433,388 B2
(45) Date of Patent: Sep. 6, 2022

(54) MANUAL METERING DEVICE

(71) Applicant: IKA-Werke GmbH & Co. KG, Staufen (DE)

(72) Inventor: Philip Döbele, Freiburg (DE)

(73) Assignee: IKA-Werke GmbH & Co. KG, Staufen (DE)

( * ) Notice: Subject to any disclaimer, the term of this patent is extended or adjusted under 35 U.S.C. 154(b) by 719 days.

(21) Appl. No.: 16/349,534

(22) PCT Filed: Oct. 6, 2017

(86) PCT No.: PCT/EP2017/001184
§ 371 (c)(1),
(2) Date: May 13, 2019

(87) PCT Pub. No.: WO2018/086723
PCT Pub. Date: May 17, 2018

(65) Prior Publication Data

US 2019/0283016 A1 Sep. 19, 2019

(30) Foreign Application Priority Data

Nov. 14, 2016 (DE) ..... 10 2016 121 810.3

(51) Int. Cl.
*B01L 3/02* (2006.01)

(52) U.S. Cl.
CPC ..... *B01L 3/0217* (2013.01); *B01L 3/0279* (2013.01); *B01L 2200/025* (2013.01); *B01L 2300/026* (2013.01)

(58) Field of Classification Search
CPC ..... B01L 2200/0605; B01L 2200/143; B01L 2200/146; B01L 2200/147; B01L 2300/02; B01L 2300/023; B01L 3/0237; B01L 2200/14; B01L 3/02; B01L 3/022; B01L 2200/00; B01L 2300/021; B01L 2300/0627; B01L 2300/0636; B01L 2300/0663;
(Continued)

(56) References Cited

U.S. PATENT DOCUMENTS 9,044,749 B2 6/2015 Wilmer
9,339,811 B2 5/2016 Schmidt
(Continued)

FOREIGN PATENT DOCUMENTS

EP 0152120 A2 8/1985
EP 2633915 A2 9/2013
(Continued)

OTHER PUBLICATIONS

International Search Report from PCT Application No. PCT/EP2017/001184, dated Oct. 6, 2017.

*Primary Examiner* — John Fitzgerald
*Assistant Examiner* — Truong D Phan
(74) *Attorney, Agent, or Firm* — Budzyn IP Law, LLC

(57) ABSTRACT

For simplified dismantling of manual metering devices (1), the manual metering device (1) proposed is one which comprises the component carrier (5). This component carrier (5) can be pushed into its use position in the housing (4) through the insertion opening (10) present in the housing (4). The releasable connection (11), which can be released in particular from the outside, is provided for the releasable fastening of the component carrier (5) in its use position within the housing (4).

18 Claims, 3 Drawing Sheets

(58) Field of Classification Search
CPC ..... B01L 2300/0861; B01L 2300/12; B01L 2300/123; B01L 2300/14; B01L 2300/18; B01L 2300/1888; B01L 2400/0478; G01N 35/00871; G01N 35/1009; G01N 35/1016
See application file for complete search history.

(56) References Cited

U.S. PATENT DOCUMENTS

| | | | | |
|---|---|---|---|---|
| 2010/0011889 | A1* | 1/2010 | Lemmo | B01L 3/0224 73/864.34 |
| 2013/0224087 | A1* | 8/2013 | Reichmuth | B01L 3/0217 422/521 |

FOREIGN PATENT DOCUMENTS

| | | | | |
|---|---|---|---|---|
| EP | 2735369 | A1 | 5/2014 | |
| WO | 2011148365 | A1 | 12/2011 | |
| WO | WO-2011148365 | A1 * | 12/2011 | B01L 3/0217 |

* cited by examiner

MANUAL METERING DEVICE

FIELD OF THE INVENTION

The invention relates to a manual metering device, in particular a pipette, having a main body, which has a housing, in which further components of the manual metering device, in particular components of a pipetting mechanism, of an ejecting mechanism and/or of a volume-adjustment mechanism of the manual metering device are arranged. Different embodiments of such manual metering devices are known from the prior art.

BACKGROUND OF THE INVENTION

In the case of maintenance or repair, it can be necessary for components of such a manual metering device to be changed over. For this purpose, convenient dismantling of the manual metering device would be desirable, in particular when the manual metering device is of high quality and is therefore comparatively expensive.

In the case of manual metering devices known from the prior art, dismantling is often not possible without connecting parts or housing parts of the manual metering devices being destroyed.

SUMMARY OF THE INVENTION

The object of the invention is therefore to provide a manual metering device of the type mentioned in the introduction of which the general handling, in particular the handling thereof during dismantling, is simplified in comparison with the manual metering devices which are already known from the prior art.

This object is achieved, in the case of a manual metering device of the type mentioned in the introduction, by the means and features of the independent claim which is directed to such a manual metering device. In the case of the manual metering device which is defined in the introduction, it is in particular proposed, for the purpose of achieving the object, that the manual metering device should comprise a component carrier, which in the use position is positioned in the housing and on which the components are arranged, that the housing should have an insertion opening, through which the component carrier can be pushed into its use position in the housing, and that the component carrier should be fastened within the housing by means of a releasable connection. The connection can be configured here such that it can be released from outside the housing.

If the component carrier can be pushed into the housing, through the insertion opening, along a longitudinal axis or a longitudinal center axis of the manual metering device, the component carrier can be secured axially into its use position by the releasable connection.

In the case of an expedient embodiment of the manual metering device according to the invention, it is possible for the insertion opening to be arranged at an end of the housing which is directed away from the head end, and therefore itself to be directed away from the head end. For dismantling of the manual metering device, the component carrier can be removed from the housing, through the insertion opening, once the connection has been released.

It can be particularly advantageous if the connection by which the component carrier is fastened in its use position in the interior of the housing is a form-fitting connection. The handling of the manual metering device according to the invention can be simplified, in addition, if the aforementioned connection for fixing or securing the component carrier in particular axially within the housing can be established by virtue of the component carrier being pushed into the housing.

The use of a component carrier is associated with the advantage that in particular small components of the manual metering device can be preassembled on the component carrier prior to the individual parts of the manual metering device being definitively assembled. This can take place before the component carrier is pushed into the interior of the housing. This can simplify in particular the handling of small or extremely small components, since there is no need for these to be introduced individually into the comparatively narrow housing of the manual metering device. It is therefore possible for the component carrier which belongs to the manual metering device according to the invention and has been prefitted with individual components to be pushed into the interior of the housing, through the comparatively large insertion opening, without any great difficulty.

In particular when the connection for fastening the component carrier in the housing can be established by virtue of the component carrier being inserted or pushed into the housing, it is possible for the component carrier to be positioned in the housing, and fixed, in one operating step.

In the case of a particularly advantageous embodiment of the manual metering device according to the invention, provision can be made for the manual metering device to have a holder forming the connecting element of the connection, which holder can be, or is, arranged in the housing. By means of this holder, the component carrier can be fastened in its use position, in which it has been inserted into the housing, and secured axially in particular in the removal direction of the component carrier. The special feature in using such a holder is that the housing itself does not need any separate fastening elements in order for the component carrier to be secured within the housing.

Provision can be made here for it to be possible for the holder to be introduced into the housing through a head opening, which is formed in the housing and is located opposite the insertion opening, in order for the holder to be moved into its retaining position.

If use is made of such a holder, it can be advantageous if the housing has a holder stop. This holder stop can help delimit a depth to which the holder can be inserted in the insertion direction, and can thus help secure the holder axially within the housing of the manual metering device. In addition, the housing can also have a component-carrier stop. This component-carrier stop can delimit a depth to which the component carrier can be inserted into the housing of the manual metering device, and can thus secure the component carrier axially in the insertion direction. The holder stop and the component-carrier stop thus prevent the holder and the component carrier from being able to move closer together than an in particular axial spacing between the holder stop and the component-carrier stop. In the case of one embodiment of the manual metering device according to the invention, the holder stop and the component-carrier stop can be formed on mutually remote sides of a shoulder which is present in or on the housing.

The connection can be a snap-fit connection which can be released in a non-destructive manner. This which can be released in a non-destructive manner, and by which the component carrier is fastened within the housing, can comprise at least one snap-fit element and a correspondingly designed mating snap-fit element. The snap-fit element can be, for example, a snap-fit hook or a latching element. The mating snap-fit element can be, for example, a mating snap-fit hook or a latching hollow, which is designed to correspond to the latching element.

In the case of one embodiment of the manual metering device according to the invention, provision is made for at least one snap-fit element to be arranged on the component carrier and at least one mating snap-fit element to be arranged either on the housing itself or on a, for example the aforementioned, holder, which can be pushed into the housing. It is likewise conceivable for the arrangement of snap-fit elements and mating snap-fit elements to be provided the other way round. Therefore, provision can likewise be made for the at least one mating snap-fit element to be arranged on the component carrier and for the at least one snap-fit element to be arranged on the housing or, in the case of a different embodiment of the manual metering device according to the invention, on a, for example the already aforementioned, holder, which can be pushed into the housing.

In order for the component carrier to be retained under a certain level of prestressing in its use position, and thus also for the releasable connection to be secured with the aid of this prestressing, it can be expedient if the manual metering device, preferably within the housing, has a restoring element, counter to the restoring force of which the component carrier can be pushed into its use position within the housing and of which the restoring force acts on the connection and the elements thereof, in particular on the at least one snap-fit element and the at least one mating snap-fit element, such that the connection is prestressed.

The restoring element can be, for example, a restoring spring and/or a resilient element, which acts on the component carrier and, if a holder, as has been previously described, is provided, also on the holder. The resilient restoring element can consist, for example, of plastic, rubber or synthetic rubber.

In order for it to be possible for the connection for fixing the component carrier within the housing to be conveniently released, provision can be made for the housing and/or also the component carrier to have at least one insertion slot, through which a tool can be introduced into the housing, up to a connecting location, in order to release the connection. The connecting location here can be the location at which for example the at least one snap-fit element and the at least one mating snap-fit element are latched to one another. For the purpose of releasing this latching, by which the connection designed in the form of a releasable snap-fit connection is established, an appropriately designed tool can then be advanced through the insertion slot up to the connecting location. There is no need here for a special tool to be used. In the simplest scenario, it is sufficient for an appropriately narrow screwdriver or a blade or a comparable shank-like element to be advanced through the insertion slot up to the connecting location, in order for the connection to be released and the component carrier to be pulled out of the housing, through the insertion opening, counter to the insertion direction.

In the case of one embodiment of the manual metering device according to the invention, provision can be made for the component carrier to have a component-carrier base, which in the use position of the component carrier is arranged adjacent to the insertion opening of the housing. This component-carrier base can be designed in the form of a component-carrier ring. This is expedient in particular when the housing of the manual metering device has an essentially rotationally symmetrical cross section. At least one component-carrier arm can then extend in the axial direction from said component-carrier base. A, for example the already aforementioned, snap-fit element or a, for example the already aforementioned, mating snap-fit element can be formed on the component-carrier arm.

If use is made of a holder, as has already been described above, it can be expedient if this holder has a holder base. If the housing of the manual metering device and/or the component carrier have/has an essentially rotationally symmetrical or round cross section, it can also be expedient here if the holder base is designed in the form of a holder-base ring. At least one holder arm can extend in the axial direction from said holder base or from said holder-base ring. A, for example the already aforementioned, snap-fit element or a, for example the already aforementioned, mating snap-fit element can be formed on the holder arm.

In the use position of the component carrier within the housing of the manual metering device, it is thus possible for the snap-fit elements and mating snap-fit elements arranged on the at least one component-carrier arm and on the at least one holder arm to be arranged in a connecting position in relation to one another and for the connection to be established.

The snap-fit element and the mating snap-fit element can each have end-side slopes which complement one another. These complementary end-side slopes can make it easier to establish the connection for fixing the component carrier within the housing of the manual metering device. This is because, when the snap-fit element moves relative to the mating snap-fit element, the two complementary slopes first of all come into contact with one another. This, in particular axial, movement can be converted, with the aid of the two complementary slopes, into a lateral yielding movement of the snap-fit element relative to the mating snap-fit element or vice versa. In this way, a lateral yielding movement of the snap-fit element relative to the mating snap-fit element, which may be necessary for establishing the connection, can be produced by virtue of the component carrier being pushed into the housing through the insertion opening. Once the two complementary slopes have slid past one another, the connection between the snap-fit element and the mating snap-fit element closes automatically on account of the material-induced restoring forces of the two elements.

If use is made of a component-carrier arm and of a holder arm, the elasticity of the two arms, which is present on account of the length of said two arms, can be utilized for this purpose.

At its end which in the use position is adjacent to the insertion opening of the housing, the component carrier can have a fastening means for fastening a fluid-dispensing unit of the manual metering device. This fastening means can be designed in the form of a thread which matches a mating thread on the fluid-dispensing unit. The fluid-dispensing unit can be, for example, a so-called piston unit.

Such a piston unit can comprise a pipette shaft, in which a dispensing channel with a dispensing opening is formed. It is then possible for example for a pipette tip to be fitted onto a free end of the pipette shaft, the inner volume of said pipette tip corresponding with the dispensing opening, that is to say being in pressure connection therewith. The piston unit can also comprise an accommodating space, which is connected to the dispensing channel and can be designed in the form of a cylinder. When a pipetting mechanism of the manual metering device is actuated, that is to say when a pipetting button is actuated, a piston penetrates into said cylinder and displaces an air cushion in the interior of the cylinder. A volume of liquid which is provided within a pipette tip fitted onto the free shaft end can be supplied from the pipette tip by virtue of the air cushion being displaced in the interior of the cylinder in the direction of the dispensing channel in the pipette shaft, and in the direction of a dispensing opening of the dispensing channel. When the piston is pulled back out of the cylinder of the piston unit and the air cushion shifts back into the cylinder, a negative pressure arises at the dispensing opening and at the pipette tip, and said negative pressure allows liquid to be drawn into the pipette tip.

BRIEF DESCRIPTION OF THE DRAWINGS

An exemplary embodiment of the invention will be described in more detail hereinbelow with reference to the drawing, in which, partially schematically.

DETAILED DESCRIPTION OF THE INVENTION

Figure 1:
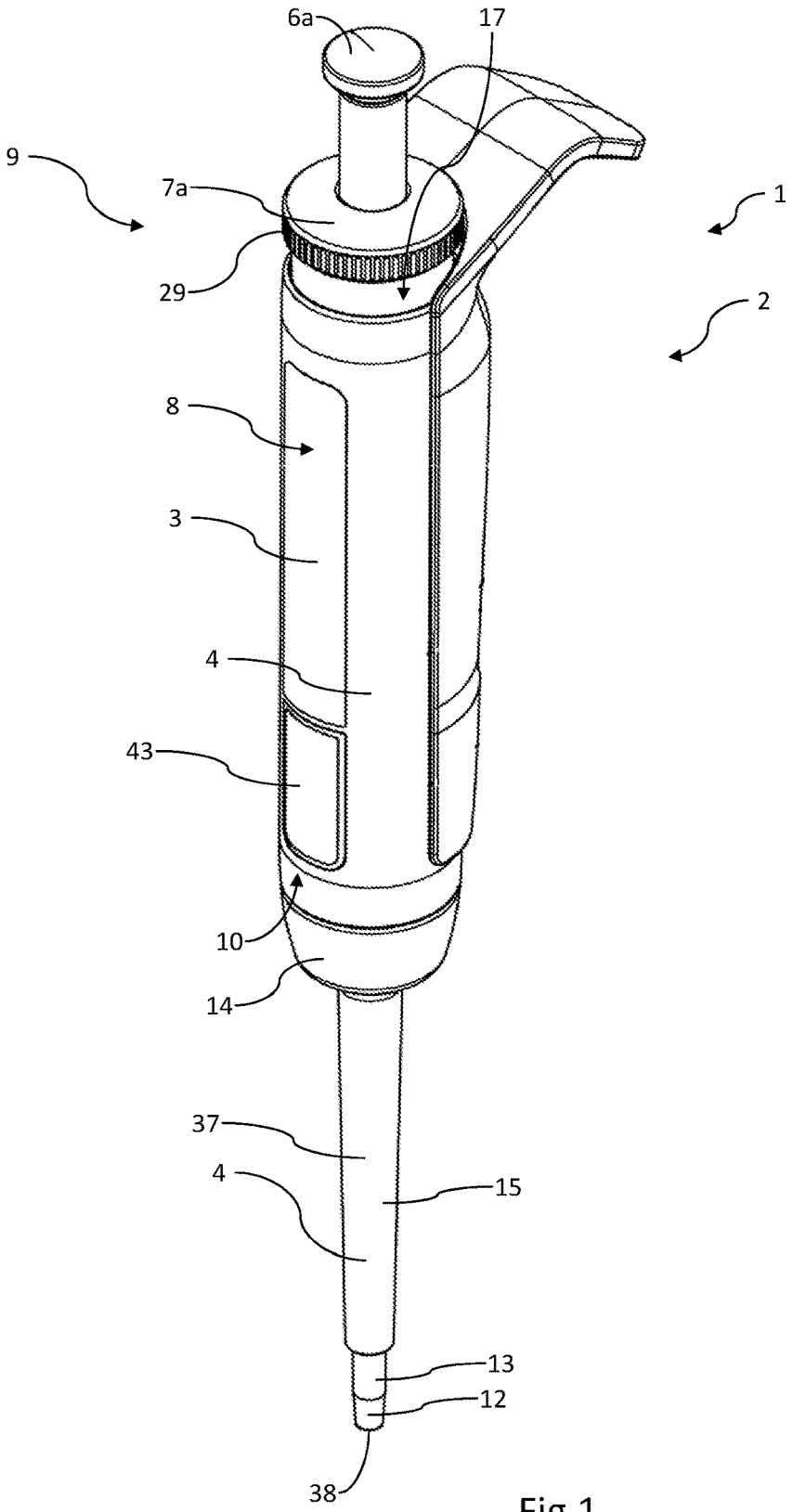
FIG. 1 shows a side view of a manual metering device designed in the form of a pipette, wherein it can be seen that the pipette has an upper part with a housing and a handle and also has a lower part designed in the form of a fluid-dispensing unit.
Figure 2:
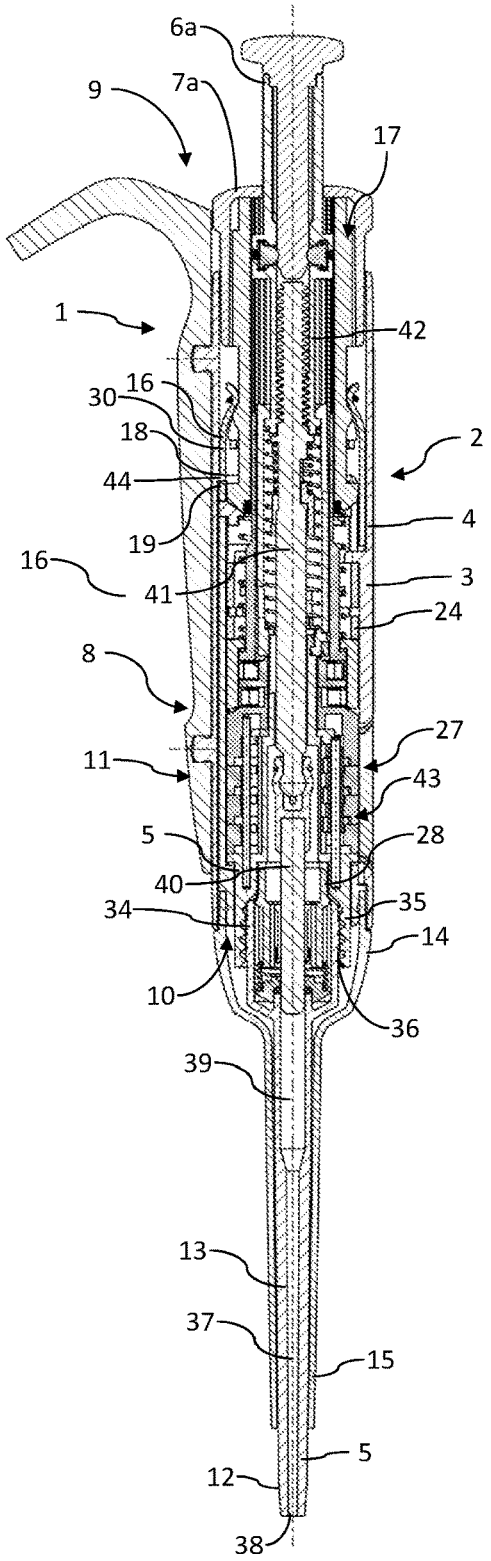
FIG. 2 shows a sectional side view of the manual metering device illustrated in FIG. 1, wherein a component carrier of the manual metering device can be seen in the interior of the housing.

FIGS. 1 and 2 show a manual metering device which is denoted as a whole by the number 1 and present case is designed in the form of a pipette 2.

The pipette 2 comprises a main body 3, which forms an upper part of the manual metering device 1 illustrated in FIGS. 1 and 2. The main body 3 has a housing 4 and a component carrier 5, which in the use position is positioned in the housing 4. Further components of the manual metering device 1 are arranged on said component carrier 5. These components are constituent parts of a pipetting mechanism 6 with a pipetting button 6*a*, of an ejecting mechanism 7 with an ejecting button 7*a*, and of a volume-adjustment mechanism 8. The ejecting mechanism 7 is triggered by virtue of the ejecting button 7*a* being pushed. The volume-adjustment mechanism 8 can be operated by means of the ejecting button 7*a* for actuating the ejecting mechanism 7. To this extent, the ejecting button 7*a* has a double function.

The housing 4 comprises an insertion opening 10, which is directed away from a head end 9 of the housing 4 and through which the component carrier 5 is pushed into its use position in the housing 4. The component carrier 4 is fastened, and secured axially, within the housing 4 by means of a releasable connection 11.

The already aforementioned ejecting mechanism 7 is used for the purpose of ejecting, as required, a pipette tip, which has been fitted onto a free end 12 of a pipette shaft 13 of the manual metering device 1. For this purpose, a fluid-dispensing unit 14, which forms a lower part of the manual metering device 1 illustrated in FIGS. 1 and 2, has an ejector sleeve 15, which can be displaced axially, in relation to a longitudinal axis of the pipette shaft 13, in the direction of the free shaft end 12 when the ejecting button 7*a* is actuated.

The connection 11 for fixing the component carrier 5 within the housing 4 is a form-fitting connection. This connection is established by virtue of the component carrier 5 being pushed into the housing 4 through the insertion opening 10.

The connection 11 is established with the aid of a holder 16 of the manual metering device 1. The holder 16 is arranged in the housing 4 and serves as a connecting element of the connection 11. In its function as connecting element, the holder 16 allows for a flow of forces between the component carrier 5 and the housing 4 of the manual metering device 1 according to the invention. By means of the holder 16, it is thus possible for the component carrier 5 in its use position, in which it has been inserted into the housing 4, to be secured axially in the removal direction of the component carrier 5. This means that, as soon as the connection 11 has been established, it is no longer possible for the component carrier 5, on account of the action of the holder 16, to be pulled out of the housing 4 without the connection 11 having been released beforehand.

The holder 11 is introduced into the housing 4 through a head opening 17, which is formed in the housing 4 and is located opposite the insertion opening 10, and it is positioned in its retaining position.

The housing 4 has a holder stop 18. This holder stop 18 secures the holder 16 axially in the insertion direction. This means that the holder 16 can be introduced into the housing 4 only up to this holder stop 18. Furthermore, the housing 4 also has a component-carrier stop 19. In a manner analogous to the function of the holder stop 18, the component-carrier stop 19 serves to secure the component carrier 5 axially in the insertion direction and to delimit axially a depth to which the component carrier 5 can be inserted into the housing 4. The holder stop 18 and the component-carrier stop 19 are formed in the interior of the housing 4, on mutually remote sides of a shoulder 44. The component-carrier stop 19 is subjected to axial loading only indirectly by the component carrier 5. This takes place via the restoring element 24 and a pressure-exerting piece 45, which is connected to the holder 16.

The connection 11 is a snap-fit connection which can be released in a non-destructive manner. This snap-fit connection which can be released in a non-destructive manner has at least one snap-fit element 20 and a mating snap-fit element 22. The snap-fit element 20 is a snap-fit hook 21 and the mating snap-fit element 22 is designed in the form of a mating snap-fit hook 23.

Figure 4:
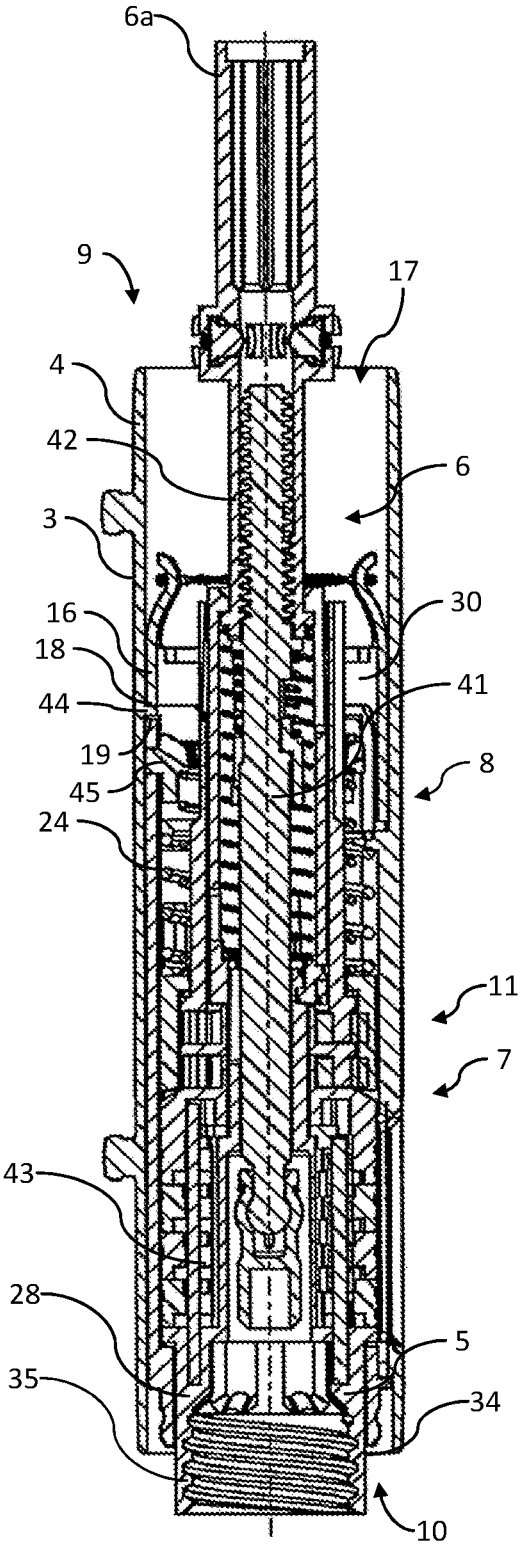
FIG. 4 shows a sectional side view of an upper part of a manual metering device which is comparable to the manual metering device illustrated in FIGS. 1 and 2.

The at least one snap-fit element 20 here is arranged on the component carrier 5 and the at least one mating snap-fit element 22 is arranged on the holder 16, which can be pushed into the housing 4. The manual metering device has a restoring element 24 in addition. This restoring element 24 is arranged within the housing 4. According to the sectional illustration of the manual metering device 1 from FIG. 2, the restoring element 24 is a flexible plastic part. In the case of the embodiment of the manual metering device 1 according to FIG. 4, said restoring element 24 is designed in the form of a restoring spring. Depending on the embodiment of the manual metering device 1, the restoring element 24 can thus be, for example, a resilient element, in particular a resilient plastic element, or a restoring spring.

The component carrier 5 can be pushed into its use position within the housing 4 counter to the restoring force of the restoring element 24. It is therefore the case that the connection 11, by which the component carrier 5 is retained in its use position within the housing 4, can be prestressed and, when the connection has been established, is in a prestressed state.

The housing 4 and, in particular, the component carrier 5 has at least one insertion slot 25. A tool 26 (cf. FIG. 5) can be introduced into the housing 4, through said insertion slot 25, into the region of a connecting location 27 in order to release the connection 11.

The component carrier 5 has a component-carrier base 28, which in the use position of the component carrier 5 is arranged adjacent to the insertion opening 10 of the housing 4. In the case of that exemplary embodiment of the manual metering device 1 which is illustrated in the figures, said component-carrier base 28 is designed in the form of a component-carrier ring. A total of two component-carrier arms 29 extend in the axial direction from the component-carrier base 28. A respective snap-fit element 20 is formed on the component-carrier arms 29. The holder 16 comprises a holder base 30, which in this case is designed in the form of a holder-base ring. In a manner similar to the component-carrier base 28, it is also the case that two holder arms 31 extend in the axial direction from the holder base 30, wherein a respective mating snap-fit element 23 is formed on each of the two holder arms 31.

Figure 5:
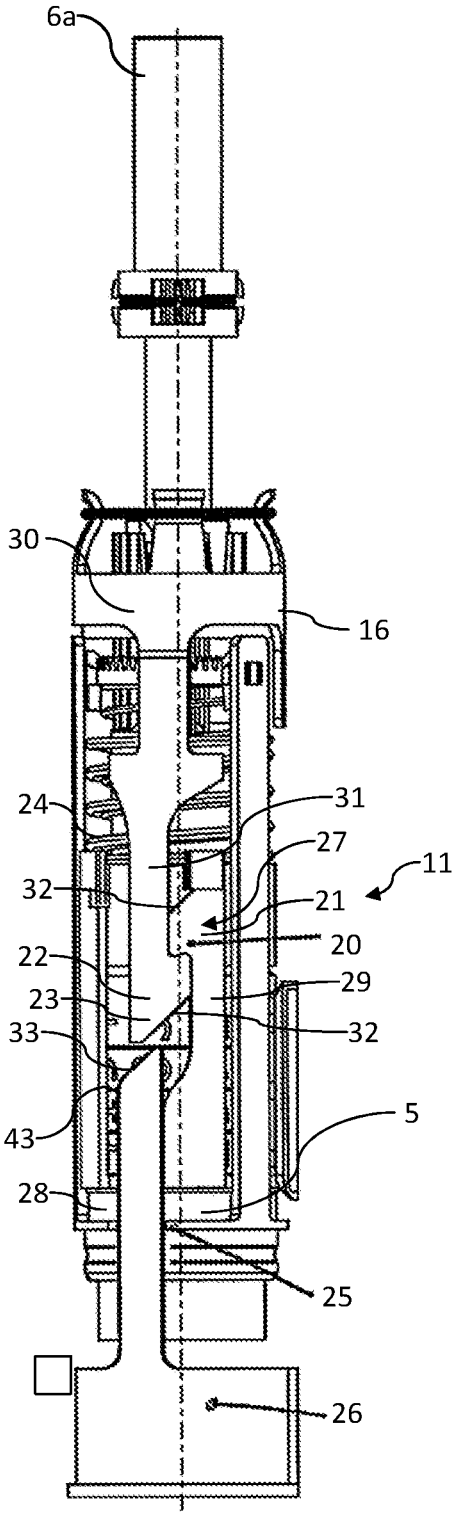
FIG. 5 shows a side view of the component carrier, illustrated in the previous figures, in the connected use position, with the holder, likewise illustrated in the previous figures, and with a dismantling tool, which is intended for releasing the connection between the holder and the component carrier and has been introduced through a slot, which is formed on the component carrier, into the vicinity of a connecting location between the component carrier and the holder.

In particular FIG. 5 shows to good effect that the snap-fit element 20 and the mating snap-fit element 22 each have end-side slopes 32 which complement one another. The slopes 32 allow the snap-fit elements 20 and mating snap-fit elements 22 to slide past one another laterally when they are moved toward one another and establish contact along the slopes 32.

The slopes 32 therefore serve to convert an axial insertion movement of the component carrier 5 into the housing 4 into a lateral yielding movement of the snap-fit elements 22 relative to the mating snap-fit elements 24. This lateral yielding movement then makes it easier for the connection 11, designed in the form of a snap-fit connection, to be snap-fitted in place or established.

In addition, the slope 32 on the end side of the mating snap-fit element 22, which is formed on the holder arm 31, serves as an engagement surface for the already aforementioned tool 26. This tool 26 has a corresponding or complementary tool slope 33 on its end side.

At its end 34 which in the use position is adjacent to the insertion opening 10 of the housing 4, the component carrier 5 has a fastening means 35 for fastening the fluid-dispensing unit 14. The fastening means 35 is designed in the form of a thread and interacts with a corresponding mating thread 36 of the fluid-dispensing unit 14, in order for the fluid-dispensing unit 14 to be connected to the main body 3 and the housing 4.

The fluid-dispensing unit 14 is designed in the form of a so-called piston unit. This piston unit comprises the already aforementioned pipette shaft 13, onto the free end 12 of which can be fitted a pipette tip, which is not illustrated specifically in the figures. The pipette shaft 13 is enclosed by the likewise already aforementioned ejector sleeve 15, which can be ejected from the free shaft end 12 by means of the ejector button 7*a* and of the ejector mechanism 7. The pipette shaft 13 contains a dispensing channel 37, which opens out, on the one hand, into a dispensing opening 38 and, on the other hand, into a cylinder 39, which is formed within the fluid-dispensing unit 14.

A piston 40 is arranged in a displaceable manner within the cylinder 39. The piston 40 is connected to a spindle 41 of the pipetting mechanism 6. When the pipetting button 6*a* is actuated, the spindle 41 is pushed axially downward, as a result of which the piston 40 is pushed into the cylinder 39 and an air cushion located in the cylinder is shifted in the direction of the dispensing channel 37 and of the dispensing opening 38 of the pipette shaft 13. This means that a volume of liquid which is provided in a pipette tip fitted onto the free end 12 of the pipette shaft 13 can be pushed out and dispensed.

The spindle 41 is, at the same time, also part of the volume-adjustment mechanism 8, which can be activated via the ejector button 7*a*. The depth to which the piston 40 can be inserted into the cylinder 39, and thus the volume which is to be pipetted, can be altered by virtue of the spindle 41 being screwed into a spindle sleeve 42 or unscrewed therefrom.

Figure 3:
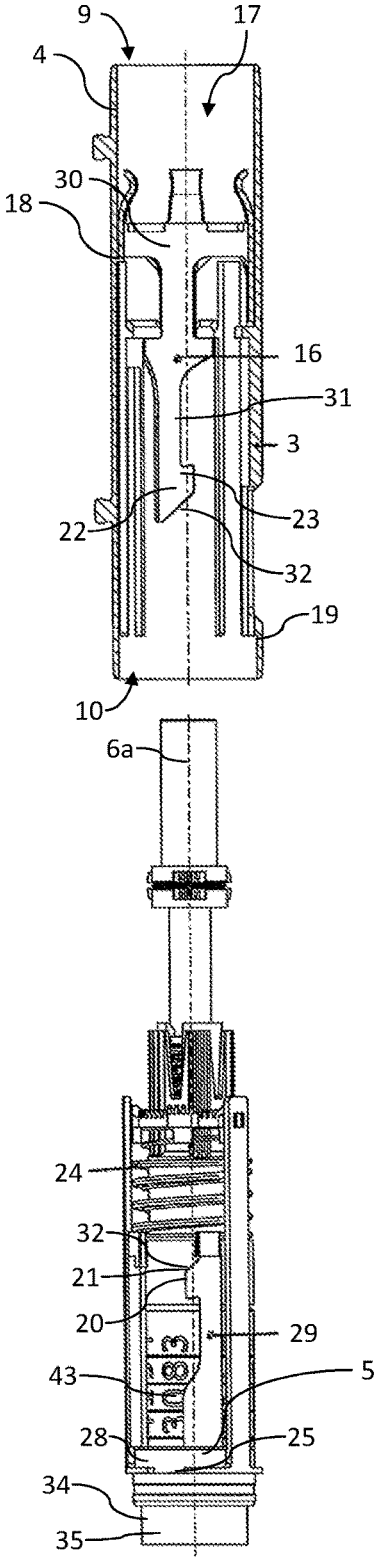
FIG. 3 shows an exploded illustration, partly in section, of the housing of the manual metering device illustrated in FIGS. 1 and 2, wherein a holder with one of two holder arms and, therebeneath, a component carrier with components of the manual metering device arranged thereon, and also with one or two carrier arms can be seen in the interior of the housing.

According to FIG. 3, the manual metering device according to the invention is connected to a volume display 43. The volume of the pipette 2 which has been preset with the aid of the volume-adjustment mechanism 8 is displayed on said volume display 43.

It should be mentioned that the component carrier 5 has two mutually opposite component-carrier arms 29, which are offset in relation to one another on the component-carrier base 28. It is also the case that the holder 16 has two holder arms 31, which are analogously offset in relation to one another on the holder base 30. This allows forces to be transmitted uniformly from the component carrier 5, via the connecting location 27 and the connection 11 closed there, to the holder 16 and, from there, to the housing 4 of the manual metering device 1.

For simplified dismantling of the manual metering device 1, the manual metering device 1 proposed is one which comprises the component carrier 5. This component carrier 5 can be pushed or inserted into its use position in the housing 4 through the insertion opening 10 formed in the housing 4. The releasable connection 11, which can be released in particular from the outside, is provided for the releasable fastening of the component carrier 5 in its use position within the housing 4.

What is claimed is:

1. A manual metering device (1), comprising: a main body (3), which has a housing (4) configured to contain components of one or more of a pipetting mechanism (6), of an ejecting mechanism (7) and of a volume-adjustment mechanism (8), of the manual metering device (1); and a component carrier (5), which, in its use position is positioned in the housing (4), the components being arranged on the component carrier (5), wherein the housing (4) has an insertion opening (10), through which the component carrier (5) is pushed into its use position in the housing (4), wherein the component carrier (5) is fastened within the housing (4) by means of a releasable connection (11), wherein the manual metering device (1) has a holder (16) forming a connecting element of the releasable connection (11), wherein the holder (16) secures the component carrier (5) in its use position, and wherein the housing (4) has a holder stop (18), which delimits a depth to which the holder (16) is inserted into the housing (4), and a component-carrier stop (19), which delimits a depth to which the component carrier (5) is inserted into the housing (4).

2. The manual metering device (1) as claimed in claim 1, wherein the component carrier (5) has a fastening means (35) for fastening to a fluid-dispensing unit (14).

3. The manual metering device (1) as claimed in claim 1, wherein the releasable connection (11) is established by the component carrier (5) being sufficiently pushed into the housing (4).

4. The manual metering device (1) as claimed in claim 1, wherein the releasable connection (11) is established in a form-fitting manner.

5. The manual metering device (1) as claimed in claim 4, wherein the releasable connection (11) is a snap-fit connection which is releasable in a non-destructive manner and comprises at least one snap-fit element (20) and at least one mating snap-fit element (22).

6. The manual metering device (1) as claimed in claim 5, wherein the component carrier (5) has a component-carrier base (28), which in the use position of the component carrier (5), is arranged adjacent to the insertion opening (10) of the housing (4) and from which at least one component-carrier arm (29) extends in the axial direction, wherein one of the at least one snap-fit element (20) and the at least one mating snap-fit element (22) is formed on the component-carrier arm (29).

7. The manual metering device (1) as claimed in claim 5, wherein the holder (16) includes at least one holder arm (31) which extends in the axial direction, wherein one of the at least one snap-fit element (20) and the at least one mating snap-fit element (22) is formed on the holder arm (31).

8. The manual metering device (1) as claimed in claim 5, wherein the at least one snap-fit element is a snap-fit hook (21) or a latching element.

9. The manual metering device (1) as claimed in claim 8, wherein the at least one mating snap-fit element (22) is a mating snap-fit hook (23) or a latching hollow.

10. The manual metering device (1) as claimed in claim 5, wherein the at least one snap-fit element (20) is arranged on the component carrier (5).

11. The manual metering device (1) as claimed in claim 10, wherein the at least one mating snap-fit element (22) is arranged on the housing (4).

12. The manual metering device (1) as claimed in claim 5, wherein the at least one snap-fit mating element (22) is arranged on the component carrier (5).

13. The manual metering device (1) as claimed in claim 12, wherein the at least one snap-fit element (20) is arranged on the housing (4).

14. A manual metering device (1) comprising: a main body (3), which has a housing (4) configured to contain components of one or more of a pipetting mechanism (6), of an ejecting mechanism (7) and of a volume-adjustment mechanism (8), of the manual metering device (1); and a component carrier (5), which, in its use position is positioned in the housing (4), the components being arranged on the component carrier (5), wherein the housing (4) has an insertion opening (10), through which the component carrier (5) is pushed into its use position in the housing (4), wherein the component carrier (5) is fastened within the housing (4) by means of a releasable connection (11), and wherein the manual metering device (1) has a restoring element (24) generating a restoring force counter to which the component carrier (5) is pushed into its use position within the housing (4), thereby prestressing the releasable connection (11).

15. A manual metering device (1) comprising: a main body (3), which has a housing (4) configured to contain components of one or more of a pipetting mechanism (6), of an ejecting mechanism (7) and of a volume-adjustment mechanism (8), of the manual metering device (1); and a component carrier (5), which, in its use position is positioned in the housing (4), the components being arranged on the component carrier (5), wherein the housing (4) has an insertion opening (10), through which the component carrier (5) is pushed into its use position in the housing (4), wherein the component carrier (5) is fastened within the housing (4) by means of a releasable connection (11), and wherein at least one of the housing (4) and the component carrier (5) has at least one introduction slot (25), through which a tool (26) is introducible into the housing (4), up to a connecting location (27), in order to release the releasable connection (11).

16. A manual metering device (1) comprising: a main body (3), which has a housing (4) configured to contain components of one or more of a pipetting mechanism (6), of an ejecting mechanism (7) and of a volume-adjustment mechanism (8), of the manual metering device (1); and a component carrier (5), which, in its use position is positioned in the housing (4), the components being arranged on the component carrier (5), wherein the housing (4) has an insertion opening (10), through which the component carrier (5) is pushed into its use position in the housing (4), wherein the component carrier (5) is fastened within the housing (4) by means of a releasable connection (11), wherein the manual metering device (1) has a holder (16) forming a connecting element of the releasable connection (11), wherein the holder secures the component carrier (5) in its use position, and wherein the holder (16) is introduced into the housing (4) through a head opening (17), which is formed in the housing (4) and is located opposite the insertion opening (10).

17. A manual metering device (1) comprising: a main body (3), which has a housing (4) configured to contain components of one or more of a pipetting mechanism (6), of an ejecting mechanism (7) and of a volume-adjustment mechanism (8), of the manual metering device (1); and a component carrier (5), which, in its use position is positioned in the housing (4), the components being arranged on the component carrier (5), wherein the housing (4) has an insertion opening (10), through which the component carrier (5) is pushed into its use position in the housing (4), wherein the component carrier (5) is fastened within the housing (4) by means of a releasable connection (11), wherein the releasable connection (11) is established in a form-fitting manner, wherein the releasable connection (11) is a snap-fit connection which is releasable in a non-destructive manner and comprises at least one snap-fit element (20) and at least one mating snap-fit element (22), wherein the at least one snap-fit element (20) is arranged on the component carrier (5), and wherein the at least one mating snap-fit element (22) is arranged on a holder (16) formed to be pushed into the housing (4).

18. A manual metering device (1) comprising: a main body (3), which has a housing (4) configured to contain components of one or more of a pipetting mechanism (6), of an ejecting mechanism (7) and of a volume-adjustment mechanism (8), of the manual metering device (1); and a component carrier (5), which, in its use position is positioned in the housing (4), the components being arranged on the component carrier (5), wherein the housing (4) has an insertion opening (10), through which the component carrier (5) is pushed into its use position in the housing (4), wherein the component carrier (5) is fastened within the housing (4) by means of a releasable connection (11), wherein the releasable connection (11) is established in a form-fitting manner, wherein the releasable connection (11) is a snap-fit connection which is releasable in a non-destructive manner and comprises at least one snap-fit element (20) and at least one mating snap-fit element (22), wherein the at least one snap-fit mating element (22) is arranged on the component carrier (5), and wherein the at least one snap-fit element (20) is arranged on a holder (16) formed to be pushed into the housing (4).

* * * * *